US008957747B2

(12) United States Patent
Wilson et al.

(10) Patent No.: US 8,957,747 B2
(45) Date of Patent: Feb. 17, 2015

(54) MULTI INTEGRATED SWITCHING DEVICE STRUCTURES

(75) Inventors: Kevin Wilson, Lake Forest, CA (US); Robert Tarzwell, Freeport (CA); Patrick McGuire, Oakland, CA (US)

(73) Assignee: Telepath Networks, Inc., Raleigh, NC (US)

( * ) Notice: Subject to any disclaimer, the term of this patent is extended or adjusted under 35 U.S.C. 154(b) by 0 days.

(21) Appl. No.: 13/281,310

(22) Filed: Oct. 25, 2011

(65) Prior Publication Data

US 2012/0161909 A1 Jun. 28, 2012

Related U.S. Application Data

(60) Provisional application No. 61/407,315, filed on Oct. 27, 2010.

(51) Int. Cl.
*H01H 51/22* (2006.01)

(52) U.S. Cl.
USPC ..... 335/78; 200/181

(58) Field of Classification Search
USPC ..... 335/78; 200/181
See application file for complete search history.

(56) References Cited

U.S. PATENT DOCUMENTS

| | | | |
|---|---|---|---|
| 5,329,520 | A | 7/1994 | Richardson |
| 5,475,353 | A | 12/1995 | Roshen et al. |
| 5,479,608 | A | 12/1995 | Richardson |
| 5,552,756 | A | 9/1996 | Ushiro |
| 5,629,918 | A | 5/1997 | Ho et al. |
| 5,787,085 | A | 7/1998 | Fox |
| 5,790,519 | A | 8/1998 | Hanson et al. |
| 5,872,496 | A | 2/1999 | Asada et al. |
| 5,982,746 | A | 11/1999 | Hanson et al. |
| 6,016,092 | A | 1/2000 | Qiu et al. |
| 6,069,540 | A | 5/2000 | Berenz et al. |
| 6,084,281 | A | 7/2000 | Fullin et al. |
| 6,094,116 | A | 7/2000 | Tai et al. |
| 6,169,469 | B1 | 1/2001 | Misumi et al. |
| 6,310,426 | B1 | 10/2001 | Birchak et al. |
| 6,310,526 | B1 | 10/2001 | Yip et al. |
| 6,335,992 | B1 | 1/2002 | Bala et al. |

(Continued)

FOREIGN PATENT DOCUMENTS

| | | |
|---|---|---|
| KR | 10-2003-0028451 | 4/2003 |
| KR | 10-2006-0078097 | 7/2006 |

(Continued)

OTHER PUBLICATIONS

Telepath Networks, Inc. et al., Form PCT/ISA/210 in connection with PCT/US2011/057907.

(Continued)

*Primary Examiner* — Bernard Rojas
(74) *Attorney, Agent, or Firm* — Greenberg Traurig, LLP; Franklin D. Ubell

(57) ABSTRACT

A switching device structure having a top layer and a bottom layer, each layer comprising a body of magnetizable material, such as permalloy, disposed within a coil wherein an armature is suspended in a cavity between the top and bottom layers, the armature having ferromagnetic material disposed on a top and bottom surface thereof. Each body of magnetizable material may be pulsed by its respective coil to switch it from a magnetic state to a non-magnetic state and then subsequently pulsed by the coil to switch it from the non-magnetic state to a magnetic state.

10 Claims, 4 Drawing Sheets

(56) References Cited

U.S. PATENT DOCUMENTS

| | | | | |
|---|---|---|---|---|
| 6,388,359 | B1 | 5/2002 | Duelli et al. | |
| 6,469,602 | B2 | 10/2002 | Ruan et al. | |
| 6,469,603 | B1 | 10/2002 | Ruan et al. | |
| 6,472,074 | B2 | 10/2002 | Sugimoto | |
| 6,496,612 | B1 | 12/2002 | Ruan et al. | |
| 6,535,663 | B1 | 3/2003 | Chertkow | |
| 6,542,379 | B1 | 4/2003 | Lauffer et al. | |
| 6,633,212 | B1 | 10/2003 | Ruan et al. | |
| 6,639,493 | B2 | 10/2003 | Shen et al. | |
| 6,653,929 | B1 | 11/2003 | Hu et al. | |
| 6,710,694 | B2 | 3/2004 | Matsuta et al. | |
| 6,785,038 | B2 | 8/2004 | Hichwa et al. | |
| 6,794,965 | B2 | 9/2004 | Shen et al. | |
| 6,812,814 | B2 | 11/2004 | Ma et al. | |
| 6,904,191 | B2 | 6/2005 | Kubby | |
| 6,947,624 | B2 | 9/2005 | Kubby et al. | |
| 7,023,304 | B2 | 4/2006 | Shen et al. | |
| 7,027,682 | B2 | 4/2006 | Ruan et al. | |
| 7,071,431 | B2 | 7/2006 | Ruan et al. | |
| 7,142,743 | B2 | 11/2006 | Bernstein | |
| 7,193,831 | B2 | 3/2007 | Anthony | |
| 7,215,229 | B2 * | 5/2007 | Shen et al. | 335/78 |
| 7,266,867 | B2 | 9/2007 | Shen et al. | |
| 7,327,211 | B2 * | 2/2008 | Ruan et al. | 335/78 |
| 7,342,473 | B2 | 3/2008 | Joung et al. | |
| 8,143,978 | B2 * | 3/2012 | Shen | 335/80 |
| 2002/0140533 | A1 | 10/2002 | Miyazaki et al. | |
| 2003/0011450 | A1 | 1/2003 | Shen et al. | |
| 2003/0043003 | A1 * | 3/2003 | Vollmers et al. | 335/78 |
| 2003/0151480 | A1 | 8/2003 | Orr | |
| 2005/0047010 | A1 | 3/2005 | Ishiwata et al. | |
| 2005/0057329 | A1 | 3/2005 | Shen et al. | |
| 2005/0270127 | A1 | 12/2005 | Six | |
| 2010/0182111 | A1 | 7/2010 | Hagihara et al. | |
| 2010/0214044 | A1 * | 8/2010 | Shen | 335/78 |
| 2011/0037542 | A1 * | 2/2011 | Page et al. | 335/78 |
| 2012/0200377 | A1 * | 8/2012 | Lee et al. | 335/179 |

FOREIGN PATENT DOCUMENTS

| | | |
|---|---|---|
| KR | 10-2009-0053103 | 5/2009 |
| WO | WO 01/57899 A1 | 8/2001 |

OTHER PUBLICATIONS

Telepath Networks, Inc. et al., Form PCT/ISA/237 in connection with PCT/US2011/057907.

Form PCT/ISA/210 in connection with PCT/US2010/042789 dated Feb. 25, 2011.

Form PCT/ISA/237 in connection with PCT/US2010/042789 dated Feb. 25, 2011.

* cited by examiner

MULTI INTEGRATED SWITCHING DEVICE STRUCTURES

CROSS REFERENCE TO RELATED APPLICATIONS

This application claims the benefit of and priority to U.S. Provisional Application Ser. No. 61/407,315, filed Oct. 27, 2010, entitled "Multi Integrated Switching Device Structures," the contents of which are incorporated by reference herein in its entirety.

FIELD

The subject disclosure relates to switching devices and more particularly to miniature switching device structures.

RELATED ART

Electromechanical and solid state switches and relays have long been known in the art. More recently, the art has focused on micro electromechanical systems (MEMS) technology.

SUMMARY

In an illustrative embodiment, a switching device structure comprises a top layer and a bottom layer, each comprising a permalloy plug or other magnetizable material disposed within a coil; and an armature suspended in a cavity between the top and bottom layers, the armature having ferromagnetic material disposed on each of a top and bottom surface thereof. Each permalloy plug may be pulsed by its respective coil to switch it from a magnetic state to a non-magnetic state and thereafter may be subsequently pulsed by its respective coil to switch it from a non-magnetic state to a magnetic state. Such switching of states is used to move the armature from a "contacts open" to "contacts closed" state and vice versa and to assist in holding the armature in a selected state.

DETAILED DESCRIPTION OF ILLUSTRATIVE EMBODIMENTS

Figure 1:
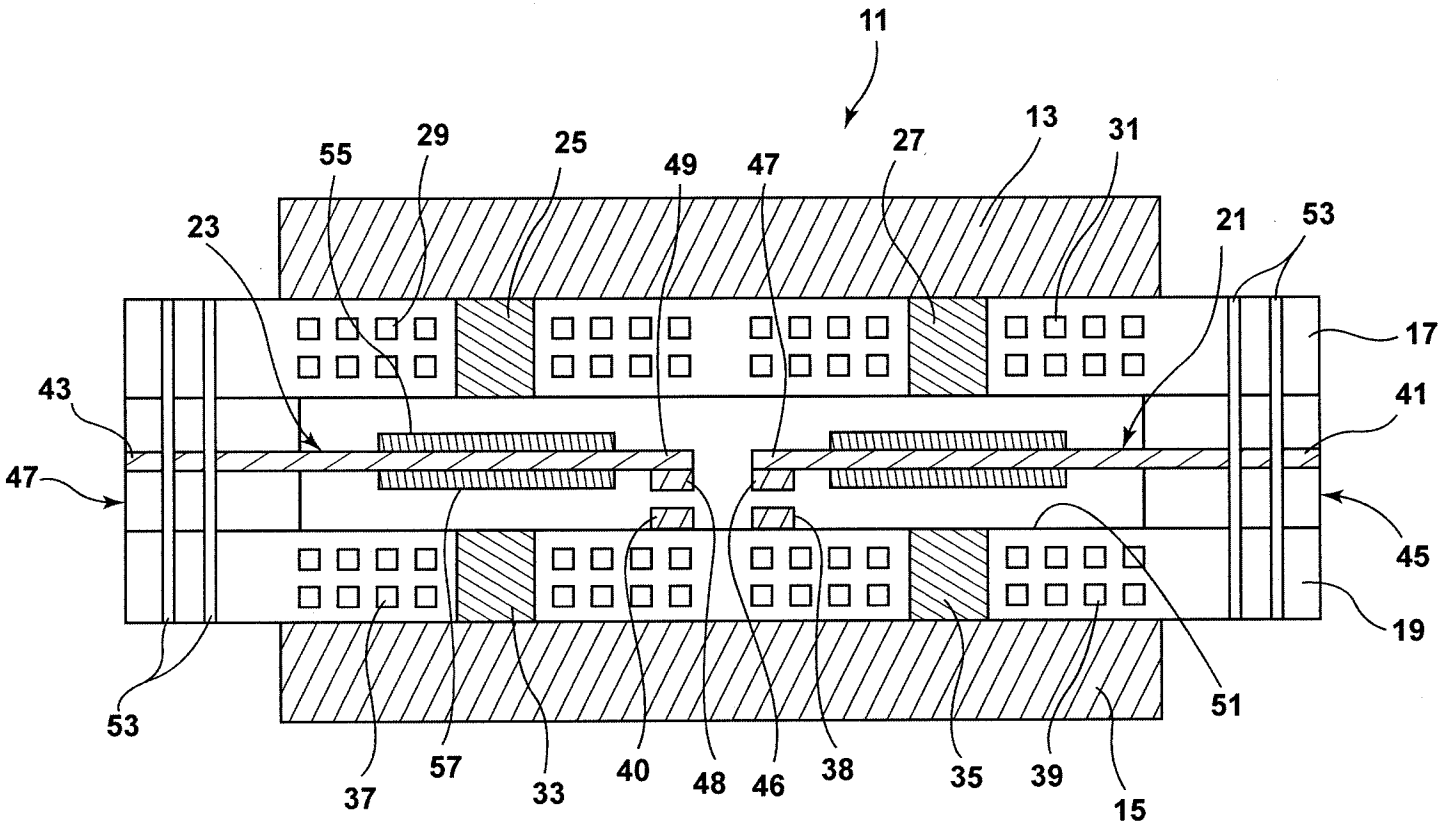
FIG. 1 is an end sectional view of an illustrative device structure.

An end sectional view of a miniature relay structure 11 is shown in FIG. 1. The relay structure 11 includes top and bottom permanent magnets 13, 15; top and bottom permalloy plug layers 17, 19; and oppositely disposed armatures 21, 23. The top and bottom magnets 13, 15, may be, for example, Neodymium magnets formed of Neodymium alloy $Nd_2 Fe_{14}$ B, which is nickel plated for corrosion protection. NdFeB is a "hard" magnetic material, i.e., a permanent magnet.

The top permalloy plug layer 17 includes vertically disposed cylindrical permalloy plugs 25, 27, each of which is centrally disposed within a respective conductive coil 29, 31. Similarly, the bottom permalloy plug layer 19 includes vertically disposed permalloy plugs 33, 35. Each permalloy plug is centrally disposed within a respective conductive coil 37, 39.

The bottom permalloy plug layer 19 also has conductive pads or relay contacts 38, 40 formed thereon. It will be appreciated that the permalloy plugs 25, 27 each comprise a body of material which may be magnetized and demagnetized and that, while permalloy is disclosed for use in an illustrative embodiment, other readily magnetizable materials could be used.

Each armature, e.g. 21, 23 may comprise a generally rectangular piece of flexible material, such as, for example, fr 4 PCB (printed circuit board) material, which also may be used to form the top and bottom layers 17, 19 and an edge layer structure 45, 47. The respective outer ends, e.g. 41, 43 of the flexible armatures are sandwiched between laminated layers of the edge layer structure 45, 47 to thereby hinge the respective armatures to the side walls of the device. Respective relay contacts 46, 48 are formed on the underside of the respective inner ends 47, 49 of each of the armatures 21, 23.

Figure 2:
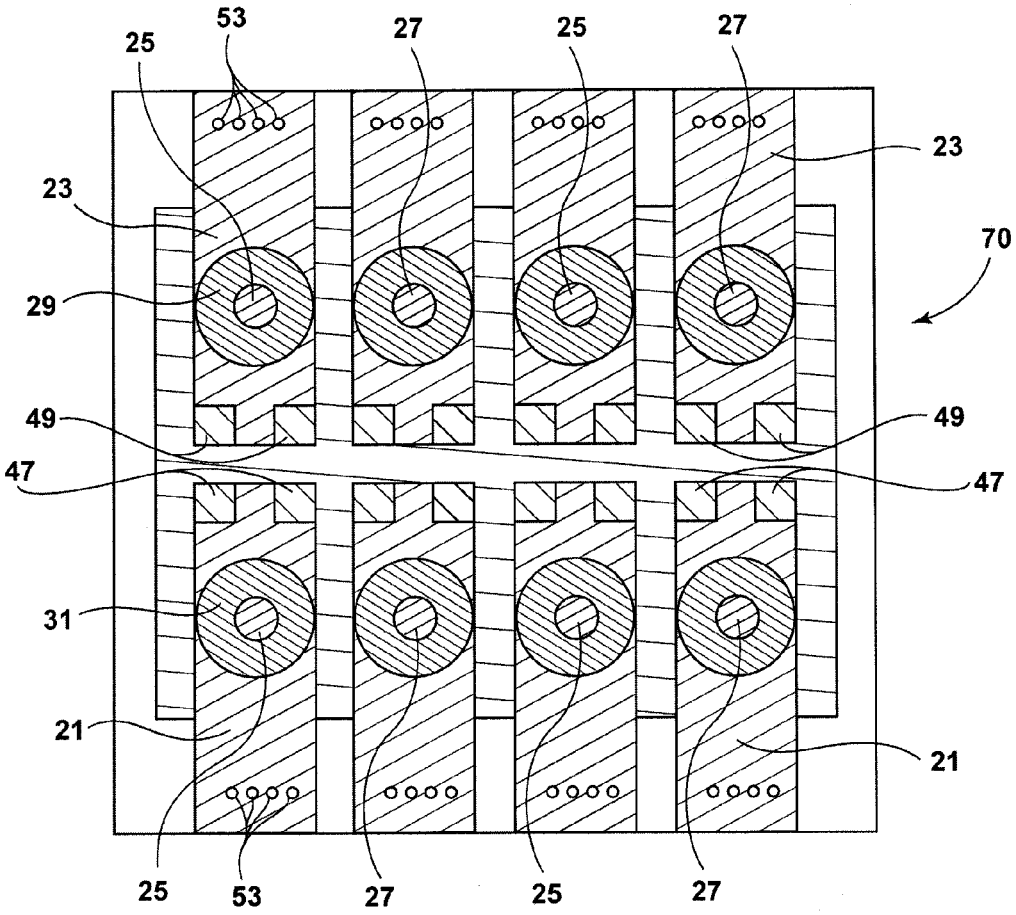
FIG. 2 is a top schematic sectional view of the embodiment of FIG. 1.

As may be better seen in FIG. 2, which illustrates a module 70 of eight relays, each armature 21, 23 actually has a pair of relay contacts, e.g., 47, 49, formed on its underside front edge and disposed above a respective pair of relay contacts 40, 38 formed on the top surface 51 of the bottom permalloy plug layer 19. Such contacts may be gold plated copper, or various other conductive metals or materials, such as, for example, conductive diamond. Respective conductive metal (e.g. copper) traces are also formed on the undersurface of each of the armatures 21, 23 and extend across the undersurface to electrically connect the contacts 40, 38 with appropriate through-hole vias, e.g., 53. Thus the armatures 21, 23 form part of a double pole (tip and ring), single throw switch.

Each armature 21, 23 further has respective ferromagnetic material layers, e.g., 55, 57 formed on its top and bottom sides. These layers 55, 57 are centrally disposed between respective top and bottom permalloy plugs 25, 33. The ferromagnetic layers 55, 57 render the armatures 21, 23 responsive to magnetic forces. In various embodiments, the ferromagnetic layers 55,57 could comprise an iron powder composition such as an iron epoxy or iron polyimide composition, a solid piece of magnetic material, or other mixture of ferromagnetic powders with a binding agent.

The vertically running vias 53 supply coil-in and coil-out current paths for each coil, e.g. 29, 37, 31, 39 and tip and ring current paths for each armature contact pair and for each base layer contact pair. Conductor paths to the vias 53 are suitably formed in the laminated layers of the structure.

In operation, each permalloy plug 25,33 acts like a magnetic switch. When the permalloy is pulsed with a coil, e.g., 29, 37, it switches from magnetic to non-magnetic. When pulsed again it switches back to magnetic. Pulsing the coils 29,37 implements two functions. First, the magnetic force generated by pulsing attracts the ferro magnetic coating 55,57 on the armature 21 to the plug 25, 33, whose coil was pulsed. Second, the magnetic force switches the permalloy "on" thereby adding to the magnetic power of the top or bottom magnet, thereby forcing the armature 21 to move to the now magnetized permalloy plug. Once the armature 21 is moved to either an up or down position through activation of the coils 29, 37, the top and bottom permanent magnets 13, 15 hold the armature 21 in that respective position until the coils are oppositely pulsed to move the armature 21 to the other respective position.

Thus, in one embodiment, to close the relay contacts 48 and 40, the top coil 29 is pulsed or driven so as to neutralize the force exerted by the top magnet 13 on the armature 21. At the same time, the bottom coil 37 is pulsed or driven so as to exert a force which pulls the armature 21 downwardly until the contacts 48 and 40 are in a closed position or state. Driving the bottom coil 37 in this manner also magnetizes the bottom permalloy plug 33 so that it exerts a holding force in a direction tending to hold the armature 21 in the closed contact position. This holding force adds to the force of the bottom magnet 15, thus securely holding the contact 40, 48 in the closed state.

To open the relay contacts 48, 40, the bottom coil 37 is pulsed so as to exert a force opposite to that of the holding force, thus neutralizing the force of the bottom magnet 15 and urging the armature 21 upward. This pulsing also demagnetizes the bottom permalloy plug 33. At the same time, the top coil 29 is pulsed in a manner which attracts the armature 21 upwardly, with the net result that the relay contacts 48 and 40 are opened to an "open" non-conducting state. The top permalloy plug 25 is also magnetized by this operation such that it thereafter assists the top magnet 13 in holding the contacts 40, 48 in the "open" state. That "open" state is maintained until the top and bottom coils 29, 37 are appropriately pulsed so as to again close the contacts 40, 48 in the manner described in the previous paragraph.

The conductive coils, e.g. 29, 31, may be planar coils such as a spiral coil formed in a single layer of a plurality of laminated layers, or may be constructed within a plurality of laminated layers, each of which contains a horizontal slice of a three dimensional coil structure and wherein the plurality of layers, when attached together, form a complete coil, similar to the coil structure taught in U.S. patent application Ser. No. 12/838,160, the subject matter of which is incorporated by this reference in its entirety herein.

The flexible armature material may have a compliance selected to reduce rotational torque requirements and may also employ conductor traces and contact pads scaled down to reduce size.

Figure 3:
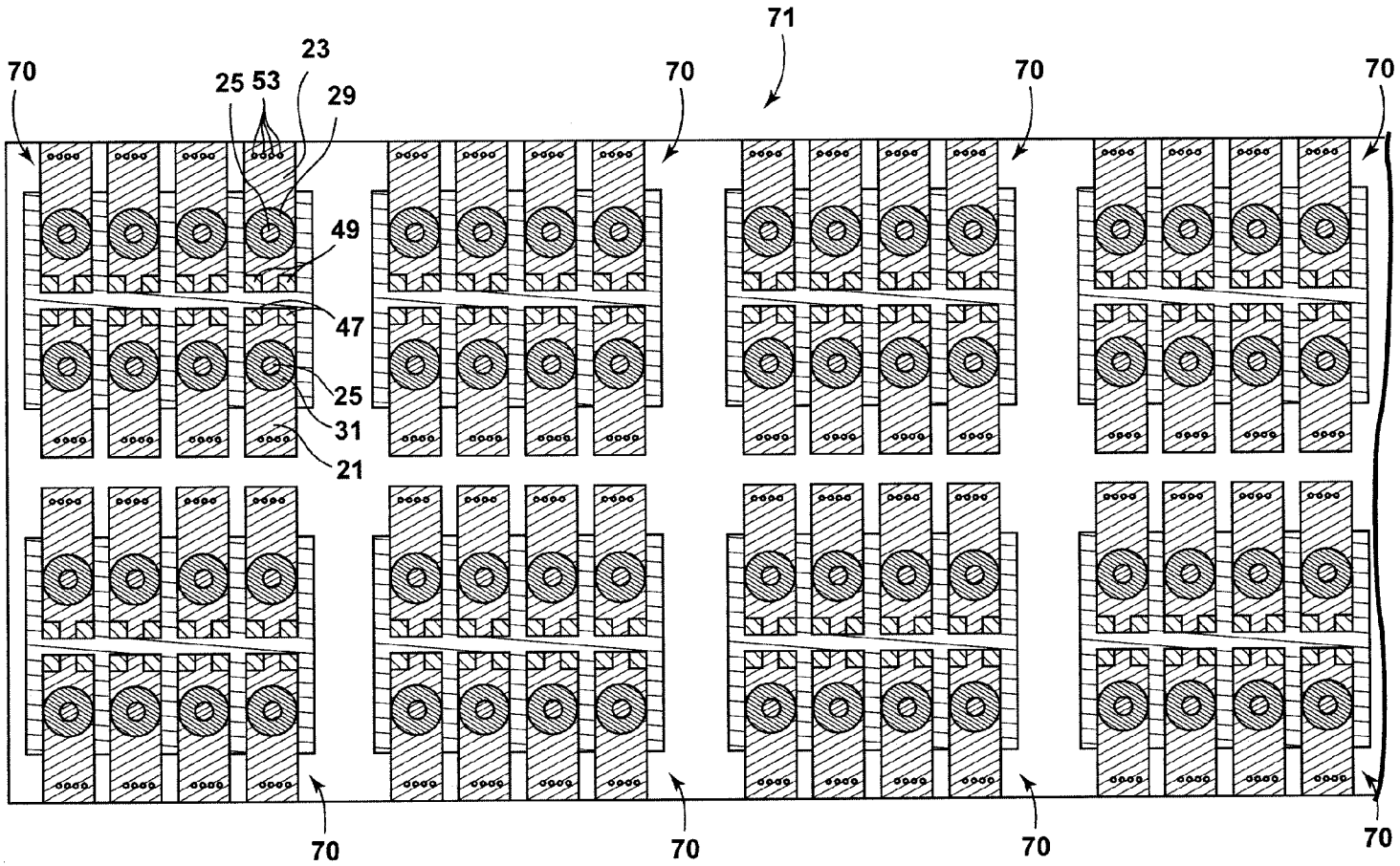
FIG. 3 illustrates the embodiment of FIGS. 1 and 2 grouped in eight groups of eight to form an 8-by-8 switch.
Figure 4:
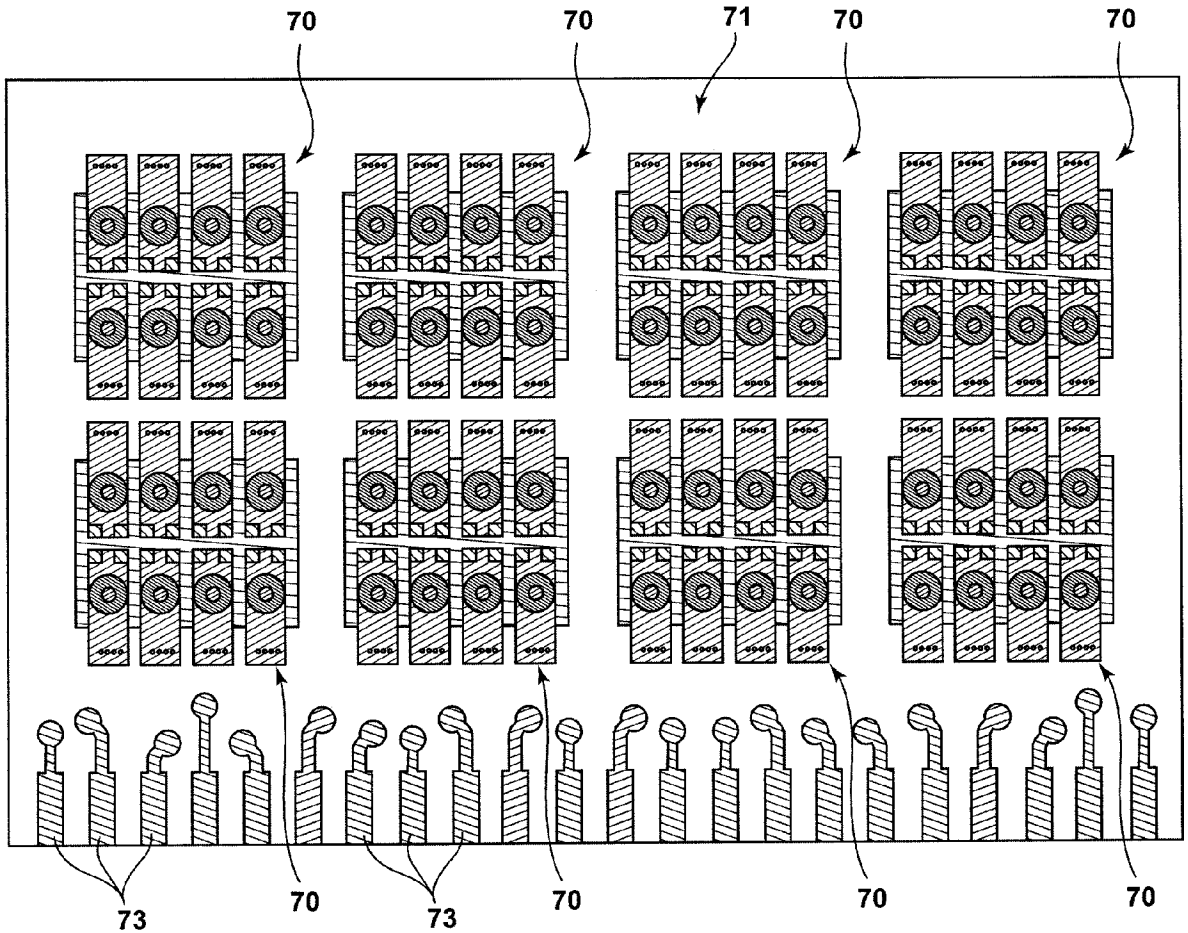
FIG. 4 illustrates the switch of FIG. 3 incorporated into an 8-by-8 module with card edge connector fingers.

Illustrative embodiments enable the construction of relatively large arrays of relays such as the "eight groups of eight" arrangement 71 illustrated in FIG. 3. Such an array 71 may be incorporated into a module with card edge conductor connection fingers, e.g. 73, as shown in FIG. 4, which may then be conveniently plugged into a standard DIMM (dual in-line memory module) socket. In one embodiment, such a module could be of a size on the order of 0.75 inches wide by 4 to 6 inches long. Other array sizes may be used in alternate embodiments such as, for example, four rows of sixteen or six rows of eight.

Those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. A switching device or relay structure comprising:

a top layer and a bottom layer, each layer comprising a body of magnetizable material disposed within a coil; and an armature suspended from a vertical sidewall of a cavity between the top and bottom layers, the armature comprising a flexible non conductive member, the flexible non conductive member having ferromagnetic material disposed on each of a top and bottom surface thereof.

2. The switching device or relay structure of claim 1 wherein each body of magnetizable material is centrally positioned between respective ends of said ferromagnetic material.

3. The switching device or relay structure of claim 2 wherein a said body of magnetizable material is pulsed by its respective coil to switch it from a magnetic state to a non-magnetic state and is subsequently pulsed by its respective coil to switch it from a non-magnetic state to a magnetic state.

4. The switching device or relay structure of claim 1 wherein each body of magnetizable material comprises a permalloy plug.

5. The switching device or relay structure of claim 2 wherein each body of magnetizable material comprises a permalloy plug.

6. The switching device or relay structure of claim 3 wherein each body of magnetizable material comprises a permalloy plug.

7. The switching device or relay structure of claim 1 wherein said flexible member has respective first and second contacts formed on an underside of one end thereof.

8. The switching device or relay structure of claim 2 wherein said flexible member has respective first and second contacts formed on an underside of one end thereof.

9. The switching device or relay structure of claim 3 wherein said flexible member has respective first and second contacts formed on an underside of one end thereof.

10. The switching device or relay structure of claim 9 wherein each body of magnetizable material comprises a permalloy plug.

* * * * *